United States Patent [19]

Kuhnert et al.

[11] 4,264,840

[45] Apr. 28, 1981

[54] LAMP/REFLECTOR UNIT

[75] Inventors: Volker Kuhnert, Kerkrade, Netherlands; Dieter Wilhelm, Eschweiler, Fed. Rep. of Germany

[73] Assignee: U.S. Philips Corporation, New York, N.Y.

[21] Appl. No.: 59,874

[22] Filed: Jul. 23, 1979

[30] Foreign Application Priority Data

Aug. 10, 1978 [DE] Fed. Rep. of Germany ..... 2834968

[51] Int. Cl.[3] ..... H01K 1/32; H01K 1/42

[52] U.S. Cl. ..... 313/115; 313/318

[58] Field of Search ..... 313/115, 113, 318

[56] References Cited

FOREIGN PATENT DOCUMENTS 2400315 7/1975 Fed. Rep. of Germany .

*Primary Examiner*—Palmer C. Demeo
*Assistant Examiner*—Darwin R. Hostetter
*Attorney, Agent, or Firm*—Robert S. Smith

[57] ABSTRACT

The invention relates to a construction of a lamp/reflector unit which is simple and which permits of connecting the light bulb in an aligned position very rapidly.

For that purpose the light bulb has a metal support plate to which are fixed metal support pins by means of respective metal flanges. After the light bulb has been adjusted to a defined position with respect to the metal support pins, the metal support plate is secured to the metal flanges by soldering or welding.

18 Claims, 7 Drawing Figures

LAMP/REFLECTOR UNIT

The invention relates to a lamp/reflector unit having a concave reflector member and a lens member attached thereto, a light bulp supported in spaced relation to the reflecting surface of said reflector member, said light bulb having a pinch seal at one end thereof from which current conductors emanate, which conductors are in electrical contact with a filament disposed within said light bulb, said pinch seal extending through and being secured to a metal support plate to which metal support pins are connected in a mutually electrically insulated manner, which pins extend in a direction opposite to that of the light bulb, each of said current conductors being attached to a respective support pin, said concave reflector member having near its apex mutually electrically insulated contact members, each of said support pins being attached to a respective contact member.

Such a lamp/reflector unit is disclosed in German Offenlegungsschrift No. 2400315 (laid open to public inspection on July 17, 1975). The lamp/reflector unit is destined for use as a vehicle headlight, notably for motorcars.

The known lamp/reflector unit has a light bulb in which two filaments are accommodated, namely a low beam filament which is partly surrounded by a metal screen and high beam filament. Light bulbs having only one filament may alternatively be used. In both cases, however, the light bulb should be mounted so that the filaments or the filament are or is aligned relative to the reflecting surface of the reflector member.

In the known unit the correct alignment of the filaments relative to the reflecting surface of the reflector member is obtained by securing the light bulb in the metal support plate so as to be aligned relative to one or more predetermined reference points in the plate. After the metal support pins which are connected to the metal support plate have been fixed to the contact members of the reflector member, the light bulb then has the correct position relative to the reflecting surface of the reflector member.

In the known unit the light bulb is aligned and cemented in the metal support plate using, mechanical-optical aligning apparatus in which the light bulb is aligned relative to the reference points on the metal support plate and is then kept aligned until the cement has sufficiently hardened to prevent any change of the position of the light bulb in the metal support plate. The actual alignment of the light bulb requires approximately 0.1 sec. whereas the hardening of the cement requires many tens of seconds. So in the manufacture of the known unit, the aligning apparatus is kept occupied by a unit much longer than is necessary for the actual alignment.

It is the object of the invention to provide a construction for a lamp/reflector unit which enables the light bulb to be aligned and secured in a very rapid manner.

This object is achieved in a lamp/reflector unit of the kind mentioned in the opening paragraph which is characterized in that each of said support pins carries a metal flange, a maximum of one pin being in electrical contact with the respective metal flange, the other ones being electrically separated from their respective flange by an insulator, said metal flange being rigidly attached to the metal support plate by a joint, selected from the group consisting of welded joints and soldered brazed joints.

Such a construction has the advantage that the light bulb can be assembled in the metal support plate outside the aligning apparatus. The light bulb need not assume an accurately defined position. The metal support pins may also be provided with their respective metal flanges outside the aligning apparatus. An assembly of the light bulb, the metal support plate and the metal support pins can now be obtained very rapidly and simply in the aligning apparatus.

The metal support pins, each provided with a respective metal flange, are that purpose provided for in a clamping device, the mutual distance between the metal support pins corresponding to the mutual distance between the respective contact members of the concave reflector member. The light bulb with the metal support plate attached thereto is then aligned relative to the metal support pins. The support pins with their respective metal flange are connected to the metal support plate, the free ends of metal support pins being cut to the required length.

If a solder is used for the connection of the metal flanges to the metal support plate, the aligning apparatus is occupiea by a lamp only for approximately 10 seconds. However, if a welded joint is made between the metal flanges and the metal support plate, the process of aligning and connecting and of cutting the support pins to length is reduced to 1 to 2 seconds.

The assembly obtained in the aligning apparatus, after the current conductors of the light bulb have each been secured to a respective metal support pin, is then inserted in a reflector member and the metal support pins connected to the contact members, for example by solder.

The construction is particularly suitable for halogen incandescent lamps in which a light bulb of quartz glass or hard glass is filled with an inert gas to which a halogen or a halogen compound has been added, for example, hydrobromic acid or a brominated hydrocarbon, for example methylene bromide.

Cement may be used for the connection of the metal support plate to the pinch seal of the light bulb and for the connection of the metal support pins to the metal flanges. The drawback of cement, however, is that it can crumble away and that at higher temperatures it may give off vapours which produce stains on the reflecting surface of the reflector member. For the connection of the metal support plate to the pinch seal of the light bulb by means of cement, the additional disadvantage occurs that cement is a poor heat conductor and hence poorly dissipates the thermal energy of the light bulb.

It is therefore recommendable to provide a metal sheath around the pinch seal of the light bulb to which the metal support plate is connected by welding or soldering. A very simple method of connecting is that in which the metal support plate is provided with resilient lugs stamped out of said plate and wherein said lugs frictionally engage said pinch seal. Such a metal support plate is described in U.S. Pat. No. 4119877 which is incorporated herein by reference.

The support pins may be fixed to the metal flanges by means of a so-called sealing glass, for example a glass of the following composition:

$SiO_2$ 64.2, BaO 13.1, $Na_2O$ 9.1, $K_2O$ 6.3, $Al_2O_3$ 5.8, $Sb_2O_3$ 0.7, $Li_2O$ 0.5, NiO 0.103, CoO 0.01, $Fe_2O_3$ 0.036, $Cr_2O_3$ 0.051, SrO 0.1 percent by weight.

The support pins may be enveloped by a glass fibre fabric so as to centre the support pins in the flange.

It is to be noted that it is not necessary for each of the metal support pins to be connected to a metal flange by means of sealing glass. In fact, the support pins are also mutually electrically insulated when at most one of the support pins is secured to the metal flange, for example, by welding or soldering and is secured via said flange to the metal support plate.

A particularly rigid construction is obtained if the metal flanges have an integral collar, over a part of the axial length of which a respective metal support pin extends therein.

The metal flanges are preferably connected on that side of a metal support plate which is remote from the major portion of the light bulb. The use of metal flanges having a collar has the advantage that the end of the support pin may be located below the surface of the metal flange so that the metal flange may engage the metal support plate throughout its surface without causing electric contact between the metal support plate and the relevant metal support pin.

In a modified embodiment, the collar tapers inwardly towards its free end, In this embodiment, the support pin may alternatively be clamped in the collar by means of ceramic moulded members e.g. of magnesium silicate. If these are proportioned so as to project just beyond the metal flange, a particularly good clamping of the metal support is obtained upon connecting the metal flange to the metal support plate.

In a particular embodiment the metal flanges together constitute an angular member. This reduces the number of components to be assembled.

The invention also relates to an assembly of light bulb, metal support plate and support pins having metal flanges suitable for being incorporated in a reflector member.

Embodiments of a unit according to the invention will now be described with reference to the accompanying drawings. In the drawings.

Figure 1:
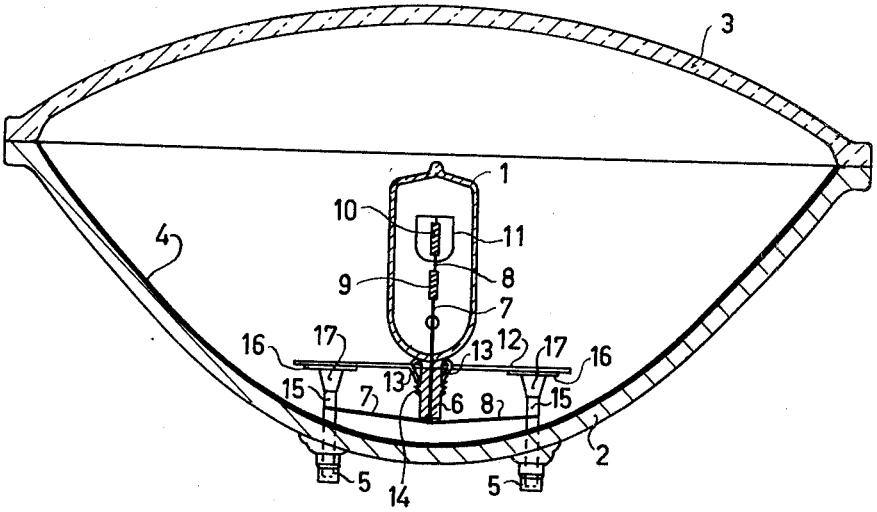
FIG. 1 is a sectional view of a lamp/reflector unit according to the invention.

In FIG. 1, a light bulb is accommodated in a concave glass reflector member 2 to which a so-called lens member 3 is sealed around its periphery. The reflector member 2 has a reflecting surface 4 and contact members 5. The light bulb 1 has a pinch seal 6 through which current conductor 7 extends to filament 9 and current conductor 8 common to filament 9 and 10 disposed in the light bulb. Filament 9 provides the high or main beam and filament 10 is partly surrounded by a screening cap 11 and provides the low, or dipped, beam. A third conductor (21 in FIG. 2), to filament 9, also extends through pinch seal 6. The light bulb 1 is filled with an inert gas and hydrogen bromide.

The pinch seal 6 extends through an aperture in a metal support plate 12 and is secured to the latter by means of resilient lugs 13 which frictionally engage said pinch seal. In this figure, ridges 14 are provided on the pinch seal 6 with which the lugs 13 engage are in engagement.

Metal support pins 15 are each connected at one end to a respective contact member 5 and at their other end they carry a respective metal flange 16 having an integral collar 17. At least two of the pins 15 are electrically insulated from their associated flange/collar arrangements 16/17, the collar 17 being shown in schematic form in FIG. 1. Some practical arrangements are described below with reference to FIGS. 3 to 5. The metal flanges 16 are secured to the metal support plate 12 by spot welds.

The current conductors 7 and 8 are each attached to a respective support pin 15. The third conductor (21 in FIG. 2) is connected to a further respective support pin 15 not included in the section shown in FIG. 1.

Figure 2:
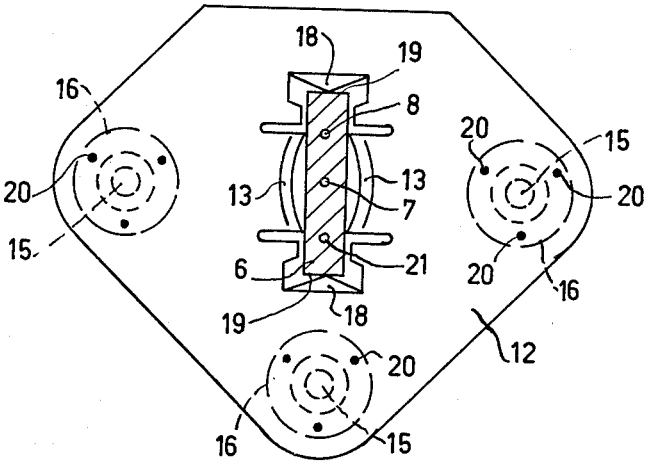
FIG. 2 is a plan view of the metal support plate shown in FIG. 1, FIGS. 3, 4 and 5 are sectional views through a metal flange placed on a metal support pin.

In FIG. 2 the metal support plate 12 has two concave resilient lugs 13 which engage the pinch seal 6 in a clamping manner, two additional lugs 18 pressing against the narrow side faces 19 of the pinch seal 6. Three support pins 15 are fixed to the metal support plate 12 via respective metal flanges 16 by means of spot welds 20. Reference numerals 7, 8 and 21 denote the three current conductors.

Figure 3:
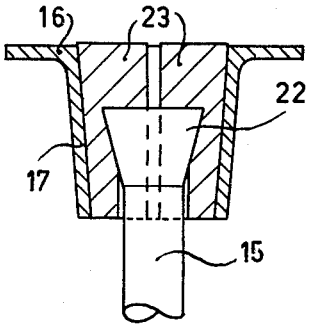

In FIG. 3 the metal flange 16 has a tapered collar 17. The support pin 15 has a widened end 22, enclosed between two ceramic mouldings 23 extending just above the surface of flange 16. This ensures that end 22 is firmly clamped between the mouldings 23 when flange 16 is welded or soldered to the support plate.

Figure 4:
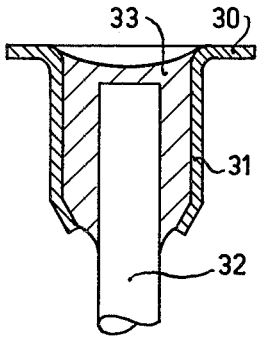

The metal flange 30 in FIG. 4 has a tubular collar 31 with an inwardly tapered free end. Metal support pin 32 extends in the collar 31 only over a part of the axial length thereof and is fixed to metal flange 30 by means of sealing glass 33.

Figure 5:
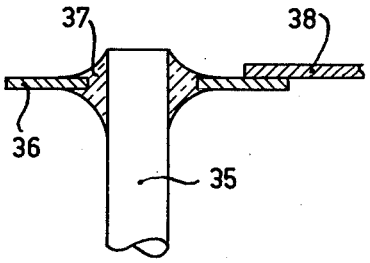

In FIG. 5 the metal support pin 35 extends through the metal flange 36 and is secured thereto by means of sealing glass 37. 38 Denotes a part of a metal support plate.

Figure 6:
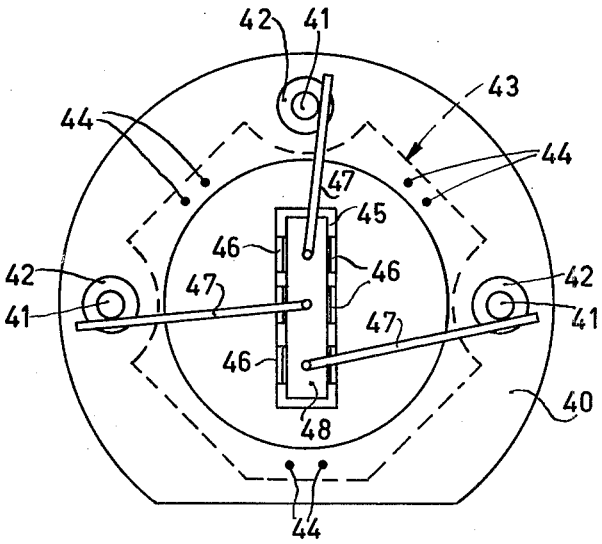
FIG. 6 is the underneath view of an assembly prior to being placed in a reflector member.

In FIG. 6 three metal support pins 41 are mounted on an annular plate 40 by means of sealing glass 42 in the manner shown in FIG. 5. A metal support plate 43 is fixed to the annular plate member 40 by means of spot welds 44. The metal support plate 43 has an aperture 45 through which a pinch seal 48 of a light bulb extends. Lugs 46 of the support plate 43 frictionally engage the pinch seal 48. Current conductors 47 emanate from the pinch seal 48 and are each connected to a respective support pin 41. In this embodiment, the flanges 36 of FIG. 5 effectively form part of the annular plate member 40.

Figure 7:
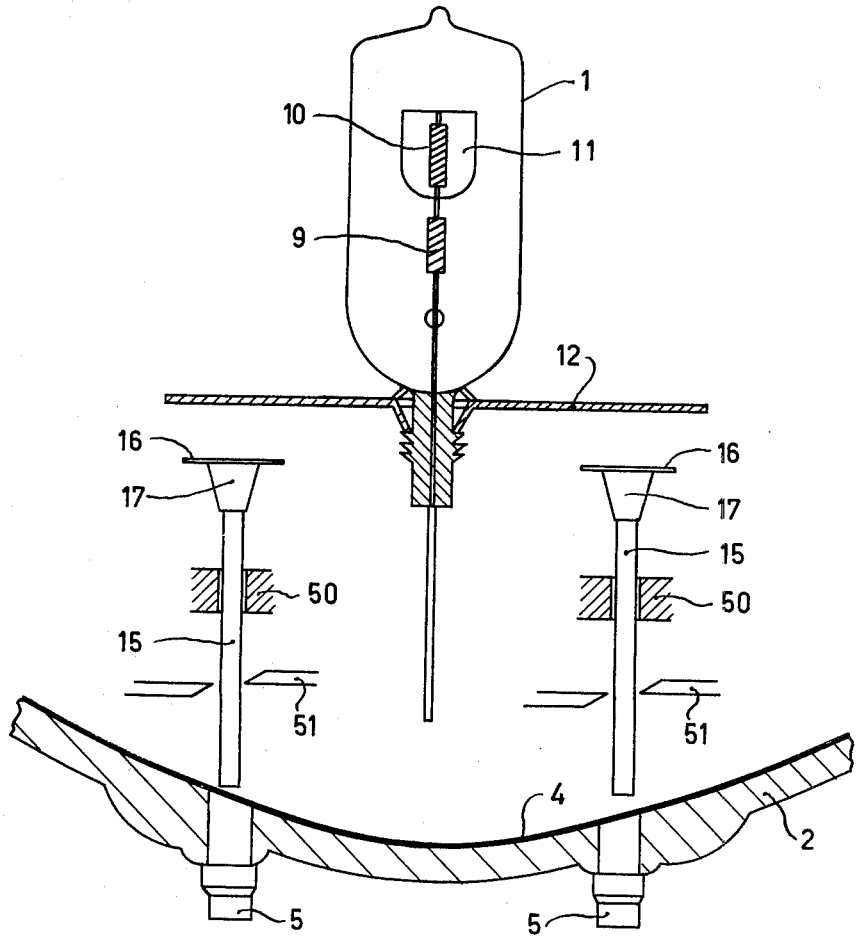
FIG. 7 is a sectional view similar to that of FIG. 1 before the component parts are assembled.

It will now be described with reference to FIG. 7 how the light bulb 1 of the unit shown in FIG. 1 is aligned with respect to the reflecting surface 4 of reflector member 2. The metal support pins 15 with their metal flanges 16 are first clamped in clamping tongs 50 which tongs are arranged in a defined spatial relationship with respect to the reflector member 2. The light bulb 1 with its connected metal support plate 12 is then provided. By moving the metal support plate 12 in the axial direction of the light bulb 1 and then moving the metal support plate 12 in the plane of the plate, the filament 10 is then moved in the previously determined tolerance field, so that afterwards the focus of the reflecting surface 4 becomes located between the filaments 9 and 10 on the centre axis of the light bulb 1. The metal support pins 15 are then moved axially against the metal support plate 12 and are secured to the metal support plate 12 via metal flanges 16, for example by spot welding. The metal support pins 15 are then cut to a previously determined size at their free ends by means of a cutter 51.

The assembly obtained can now be inverted in a reflector member 2, the ends of the support pins 15 sliding into the contact members 5 and being secured there by brazing solder.

Although the described embodiment has two filaments, the invention is of course equally applicable to lamp/reflector units having light bulbs with single filaments.

What is claimed is:

1. A lamp/reflector unit having a concave reflector member and a lens member attached thereto, a light bulb supported in spaced relation to the reflecting surface of said reflector member, said light bulb having a pinch seal at one end thereof from which current conductors emanate which are in electrical contact with a filament disposed within said light bulb, said pinch seal extending through and being secured to a metal support plate to which metal support pins are attached in a mutually electrically insulating manner, which pins extend from the plate in a direction opposite to that of the light bulb, each of said current conductors being secured to a respective support pin, said concave reflector member having near its apex mutually electrically insulated contact members, each of said support pins being attached to a respective contact member, each of said support pins being provided with a metal flange a maximum of one pin being in electrical contact with the respective metal flange, the other ones being electrically separated from their respective flange by an insulator, said metal flanges being rigidly attached to the metal support plate by a joint, selected from the group consisting of welded joints and soldered joints.

2. A lamp/reflector unit as claimed in claim 1, wherein the joint is a spot-welded joint.

3. A lamp/reflector unit as claimed in claim 1, wherein said metal flanges are attached to the surface of the metal support plate which is remote from the major portion of the light bulb.

4. A lamp/reflector unit as claimed in claim 3, wherein at least one of the metal flanges is attached to its respective support pins by means of a sealing glass.

5. A lamp/reflector unit as claimed in claim 3, wherein the metal flanges each have an integral collar extending in a direction remote from the light bulb, the support pins extending in their respective collars for only part of the axial length thereof.

6. A lamp/reflector unit as claimed in claim 5, wherein the collar tapers inwardly towards its free end.

7. A lamp/reflector unit as claimed in claim 6, wherein one end of each support pin is clamped within its respective collar by means of ceramic mouldings.

8. A lamp/reflector unit as claimed in claim 1, wherein the metal flanges form part of an annular plate member.

9. A lamp/reflector unit as claimed in claim 1 wherein the metal support plate is secured to the pinch seal of the light bulb by means of resilient lugs stamped out of said metal support plate and frictionally engaging said pinch seal.

10. An assembly of a light bulb, a metal support plate and metal support pins for use in a lamp/reflector unit, said light bulb having a pinch seal at one end thereof from which current conductors emanate which are in electrical contact with a filament disposed within said light bulb, said pinch seal extending through and being secured to a metal support plate to which metal support pins are attached in a mutually electrically insulated manner, said pins extending from the plate in a direction opposite to that of the light bulb, each of said current conductors being attached to a respective support pin, each of said support pins being provided with a metal flange, a maximum of one pin being in electrical contact with the respective metal flange, the other ones being electrically separated from their respective flange by an insulator, said metal flanges being rigidly attached to the metal support plate by a joint selected from the group consisting of welded joints and soldered joints.

11. An assembly as claimed in claim 10, wherein the joint is a spot-welded joint.

12. An assembly as claimed in claim 10, wherein said metal flanges are attached to the surface of the metal support plate which is remote from the major portion of the light bulb.

13. An assembly as claimed in claim 12, wherein the metal flanges are attached to the respective support pins by means of a sealing glass.

14. An assembly as claimed in claim 12, wherein the metal flanges each have an integral collar extending in a direction remote from the light bulb, the support pins extending in their respective associated collar for only part of the axial length thereof.

15. An assembly as claimed in claim 14, wherein each collar tapers inwardly towards its free end.

16. An assembly as claimed in claim 15, wherein one end of each support pin is clamped within its associated collar by means of ceramic mouldings.

17. An assembly as claimed in claims 10, 11, 12, 13, 14, 15 or 16, wherein the metal flanges form part of an annular plate member.

18. An assembly as claimed in claims 10, 11, 12, 13, 14, 15 or 16, wherein the metal support plate is secured to the pinch seal of the light bulb by means of resilient lugs stamped out of said metal support plate and frictionally engaging said pinch seal.

* * * * *